US006499235B2

(12) United States Patent
Lussier et al.

(10) Patent No.: US 6,499,235 B2
(45) **Date of Patent: *Dec. 31, 2002**

(54) CLEATED FOOTWEAR

(75) Inventors: Michel Lussier, Portland, OR (US); Tom Garlock, Portland, OR (US); John Earle, Erlangen (DE)

(73) Assignee: adidas International B.V. (NL)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/455,280

(22) Filed: Dec. 6, 1999

(65) Prior Publication Data

US 2002/0062578 A1 May 30, 2002

(51) Int. Cl.[7] ..... A43C 15/16
(52) U.S. Cl. ..... 36/126; 36/67 A; 36/67 B
(58) Field of Search ..... 36/67 B, 126, 36/67 R, 67 A, 67 C, 129

(56) References Cited

U.S. PATENT DOCUMENTS

| | | | | |
|---|---|---|---|---|
| 3,127,687 | A | 4/1964 | Hollister et al. | 36/2.5 |
| 4,347,674 | A | 9/1982 | George | 36/126 |
| 4,712,318 | A | 12/1987 | Greiner et al. | 36/134 |
| 4,914,838 | A | 4/1990 | Ihlenburg | 36/114 |
| 5,473,827 | A | 12/1995 | Barre et al. | 36/134 |

FOREIGN PATENT DOCUMENTS

| | | |
|---|---|---|
| EP | 0 744 907 B1 | 12/1996 |

*Primary Examiner*—Ted Kavanaugh
(74) *Attorney, Agent, or Firm*—Testa, Hurwitz & Thibeault, LLP

(57) ABSTRACT

An article of footwear is described with a sole that has a forefoot plate, a heel plate, at least one alloy cleat, and at least one molded cleat. The alloy cleat may be made of a non-ferrous metal alloy or alternatively an alloy based on ceramics, titanium, and/or magnesium. According to the invention, the alloy cleat protrudes from the forefoot plate and the molded cleat protrudes from the heel plate. The sole can additionally have a stability element that controls the movement of the forefoot plate with respect to the heel plate. An alternative aspect of the invention is an alloy cleat having a body with a generally arcuate cross-section and an integrally formed stiffening rib.

20 Claims, 7 Drawing Sheets

CLEATED FOOTWEAR

TECHNICAL FIELD

The present invention relates to an article of cleated footwear. In particular, the present invention relates to a baseball shoe including a sole having structural plates and various types of cleats mounted thereon.

BACKGROUND INFORMATION

There are four basic movements in baseball: pitching/throwing, base running, hitting, and fielding. In all four movements, a player's foot follows one basic motion pattern. Weight is placed on the player's back foot, or more precisely, the forefoot portion of the back foot. The player then rolls his weight to the medial side. From the medial side, weight is shifted onto the toe portion, where the toe-off begins, starting at the first metatarsal and finishing at the big toe. The primary traction area is the forefoot. Therefore, it is essential to maximize traction in the forefoot while allowing a player to swivel and/or pivot on their forefoot with minimum resistance.

Conventional baseball shoes are constructed of bladed steel spikes formed on a single sole plate running from toe to heel. Steel spikes are known to penetrate the ground well, providing good grip and push-off; however, baseball shoes with steel spikes are also known to be uncomfortable to a wearer. Steel spikes are uncomfortable for two reasons: (1) the wearer can typically feel the spikes through the shoes; and (2) the placement of the spikes may induce unnecessary stresses in the wearer's feet or ankles, as a result of the motion of the wearer's feet. Non-optimal spike placement and unnecessary weight can also degrade the athletic performance of the wearer. The discomfort is especially apparent when the shoes are used on hard, heavy, or dry ground conditions. Hard ground can also quickly wear down a steel spike and diminish its performance.

Other types of cleats, for example molded nylon cleats, are typically more comfortable than steel spikes; however, molded cleats trade performance for comfort. Molded cleats are typically more comfortable than steel spikes, because they provide superior pressure distribution; however, molded nylon cleats are not generally used for baseball shoes due to their inferior ground penetration characteristics, particularly on hard ground. Therefore, molded nylon cleats provide inferior traction and/or toe-off as compared to steel spikes.

An object of the invention is, therefore, to maximize the comfort and performance of a cleated shoe by selecting appropriate cleat material, design, and placement and also by selecting appropriate plate design, placement, and materials. Although only conventional baseball shoes are described in the preceding description of the prior art, the invention is applicable to all types of shoes whose performance could benefit from the incorporation of cleats.

SUMMARY OF THE INVENTION

Generally, the invention addresses the problems outlined above by means of a combination of cleat materials, designs, and placement, and the use of multiple plates with varied designs and/or materials. The inventors have discovered that the unique plate and cleat combinations of the present invention can optimize an athlete's performance. The shoe sole of the present invention provides an improved combination of traction and comfort, which enables the wearer to exercise more power and drive. In particular, a sole in accordance with the present invention increases stability, agility, balance, and acceleration, while reducing slip. The use of a heel plate, where a majority of an athlete's weight is supported, with molded cleats made from a polymer material provides increased comfort to an athlete. The forefoot plate with alloy cleats affords an athlete fine performance, because the alloy cleats penetrate the ground readily providing better grip and push-off than the molded cleats. The cleat of the forefoot plate is preferably made from a non-ferrous metal alloy, such as an aluminum-based alloy. Alternatively, the forefoot plate could incorporate cleats made of an alloy based on ceramics, titanium, and/or magnesium. Alloy cleats may offer more comfort than steel cleats in conjunction with acceptable ground penetration properties. The two plates and distinctive cleat materials and designs result in a shoe with the comfort of molded cleats and the performance of bladed steel spikes.

In one aspect, the invention relates to an article of footwear including a sole having a forefoot plate, a heel plate, at least one alloy cleat, and at least one molded cleat. The alloy cleat or cleats protrude from the forefoot plate. The molded cleat or cleats protrude from the heel plate.

In another aspect, the invention relates to an article of footwear with a sole that includes a forefoot plate, a heel plate, a stability element, at least one alloy cleat, and at least one molded cleat. The stability element couples the forefoot plate and the heel plate. The alloy cleat or cleats protrude from the forefoot plate. The molded cleat or cleats protrude from the heel plate.

The stability element of one embodiment of the invention includes a generally longitudinal lateral element, a generally longitudinal medial element, and a transverse element. The transverse element connects the lateral and medial elements and may include a plurality of fingers or finger-like elements. In one embodiment, the transverse element may include three finger elements forming a generally E-shaped element.

The stability element may extend from the forefoot plate to the heel plate and is preferably constructed of a material and configured for controlling, in a preselected manner, the rotation of the forefoot of the shoe with respect to the heel of the shoe. The stability element may support the foot over its effective longitudinal length without affecting the flexibility of the footwear with respect to the twisting of the forefoot relative to the heel. In addition, the stability element may support the front part of the foot in the forefoot area. The above mentioned material properties can be obtained by manufacturing the stability element from a composite material of resin and carbon fibers, or a thermoplastic material, or equivalent materials. The stability element may be of the type described in U.S. patent application Ser. No. 09/286,737, assigned to the same assignee as the instant application, the disclosure of which is hereby incorporated by reference in its entirety.

Various embodiments according to the foregoing aspects of the invention may include the following features. The alloy cleat may be made of a non-ferrous metal alloy, preferably an aluminum-based alloy. Alternatively, the alloy cleat may be made of a ceramic, titanium, and/or magnesium alloy. There may be four alloy cleats. There may be three or four molded cleats. The alloy or molded cleats or both may be arranged in a generally circular configuration. The generally circular configuration of the alloy cleats may be centered generally about an area of a third metatarsal. The alloy cleat or cleats may have a generally arcuate cross-section. The heel plate may have a generally circular shape. The forefoot plate may extend into the midfoot region. The forefoot plate extension into the midfoot region may be limited to the lateral side.

In still another aspect, the invention relates to an alloy cleat that includes a mounting base, a body, and a stiffening rib. The body extends from the mounting base to a distal end that may be ground-engaging. The body has a generally arcuate cross-section. The stiffening rib is formed integrally with the body and may be centrally located along the body. In one embodiment, the alloy cleats are made of a non-ferrous metal alloy, such as an aluminum-based alloy. Alternatively, the alloy cleat may be made of a ceramic, titanium, and/or magnesium based alloy. Various other embodiments of the cleat include multiple stiffening ribs formed integrally with the body, the stiffening ribs disposed at generally equal distances about the body. In addition, the body may have other cross-sectional shapes such as, linear, rectangular, or circular. Furthermore, an alloy cleat may offer improved abrasion resistance and be lighter in weight than standard steel cleats.

These and other objects, along with advantages and features of the present invention herein disclosed, will become apparent through reference to the following description of embodiments of the invention, the accompanying drawings, and the claims.

BRIEF DESCRIPTION OF THE DRAWINGS

In the drawings, like reference characters generally refer to the same parts throughout the different figures. Also, the drawings are not to scale emphasis instead generally being placed upon illustrating the principles of the invention. Further preferred embodiments of the present invention are discussed in the following with reference to the drawings which show the following.

DETAILED DESCRIPTION

Embodiments of the present invention are described below. It is, however, expressly noted that the present invention is not limited to these embodiments, but rather the intention is that modifications that are apparent to the person skilled in the art are also included. In particular, the present invention is not intended to be limited to baseball shoes.

Figure 1:
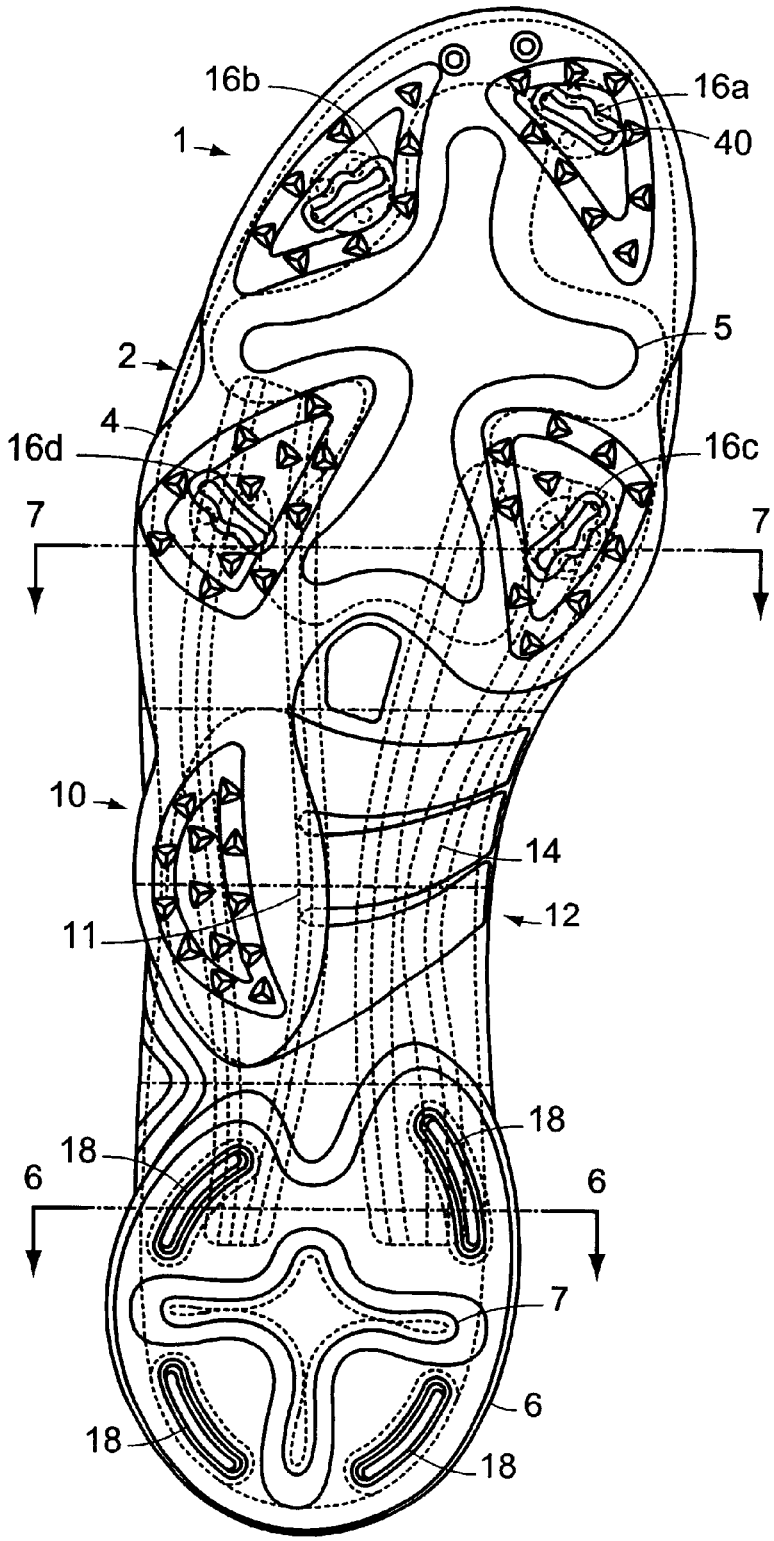
FIG. 1 is a schematic bottom view of one embodiment of a sole of an article of footwear for a right foot in accordance with the invention.

FIG. 1 is a bottom view of an article of footwear 1 having a sole 2 in accordance with the present invention. The article of footwear shown is for a right foot, the left being a mirror image of the right. The sole 2 has a lateral side 10, a medial side 12, and a midfoot region 11. The sole 2 includes a forefoot plate 4 and a heel plate 6. In one embodiment, the forefoot plate 4 is generally planar and has four alloy cleats 16*a–d* protruding therefrom. In another embodiment, the forefoot plate is contoured to cradle the foot, thereby allowing for a more natural fit and increased lateral stability. The cleats 16 are arranged in a generally circular configuration; however, the cleats 16 may be arranged in other configurations, for example, linearly. In one embodiment, the cleat configuration is centered generally about an area of a third metatarsal. In one embodiment, the forefoot plate extends into the midfoot region 11 along the lateral side 10. The forefoot plate 4 is composed of a suitable polymer material or combination of polymer materials, either with or without reinforcement, or an equivalent material. Suitable materials include thermoplastic polyurethane (TPU), thermoplastic polyether block amides, such as the Pebax® brand sold by Elf Atochem, and thermoplastic polyester elastomers, such as the Hytrel® brand sold by DuPont, or other suitable materials. Reinforcement may be by inclusion of glass or carbon graphite fibers, or other similar method. The forefoot plate may incorporate a window 5 comprised of a second material. In one embodiment, the window 5 may be used to reduce the weight or otherwise modify the properties of the forefoot plate. Possible materials for such a window 5 are TPU or other suitable material. In one embodiment, the forefoot plate 4 comprises Pebax® with a Shore hardness of about 60–70 durometer and a window comprised of TPU-ester having a Shore hardness of about 95A durometer. Other suitable materials will be apparent to those skilled in the art.

The cleats 16 are composed of an alloy, such as a non-ferrous metal alloy preferably based on aluminum. Alternatively, the cleats could be formed from alloys based on ceramics, titanium, and/or magnesium. The cleats 16 have a generally arcuate cross-section; however, the cleats 16 may also have a linear, circular, or rectangular cross-section. One method of attaching the cleats 16 to the forefoot plate 4 is illustrated in FIG. 7.

Figure 7:
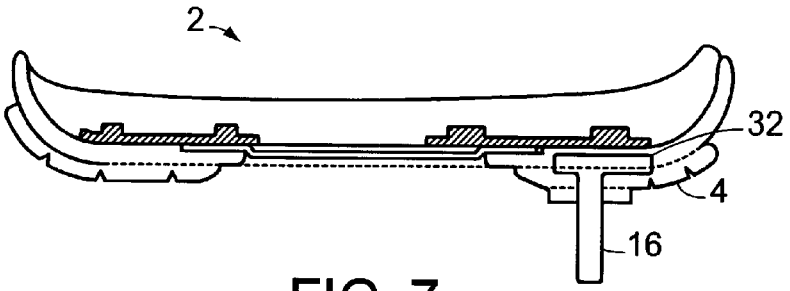
FIG. 7 is a schematic sectional view of a forefoot of an article of footwear in accordance with the invention.

FIG. 7 is a cross-sectional view of the forefoot plate 4 taken at line 7—7 and provides a detailed illustration of one cleat 16 attached to the forefoot plate 4. The cleat 16 can be incorporated into the forefoot plate 4 when the latter is produced. Attachment of the cleat 16 can be, for example, by inserting the cleat 16 into an injection mold that may be used to produce the forefoot plate 4, and then injecting a polymer or similar material into the mold. In this case, the attachment is mechanical, i.e., suitable holes or apertures 38 are formed in a mounting base 32 of the cleat 16 into which the liquid material penetrates and hardens as illustrated in FIG. 10B. Alternatively, the mounting base 32 of the cleat 16 can be inserted and clipped into a suitable recess in a forefoot plate that has already been produced.

With respect to a forefoot plate 4 with four alloy cleats 16 arranged in a generally circular configuration, a primary toe cleat 16*a* provides resistance during push-off and maximum resistance in lateral movements, a secondary toe cleat 16*b* allows quick changes of direction, a first metatarsal cleat 16*c* supports medial push off, and a fifth metatarsal cleat 16*d* provides maximum grip in straight ahead movements. In addition, the dual toe cleats 16*a*, 16*b* maximize toe-off, allowing for more power to be generated by the legs. The four alloy cleats 16*a*–16*d* provide even pressure distribution and improved traction in the primary forefoot traction area. The generally circular configuration of cleats 16*a*–16*d* allows for natural rotation of the foot with minimal resistance.

Figure 5:
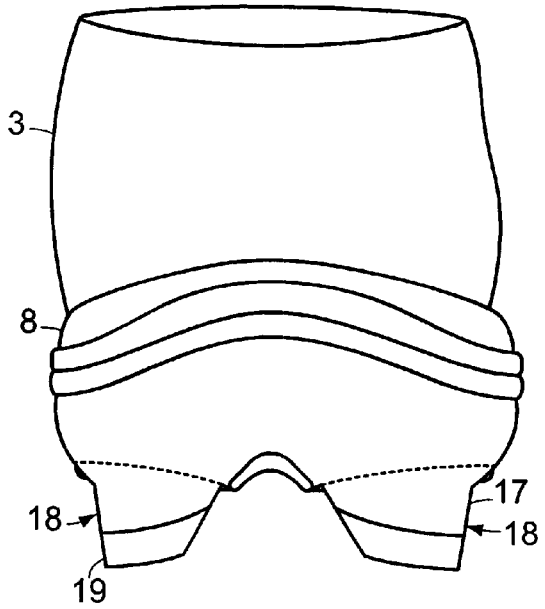
FIG. 5 is a schematic rear view of a heel of an article of footwear in accordance with the invention.
Figure 6:
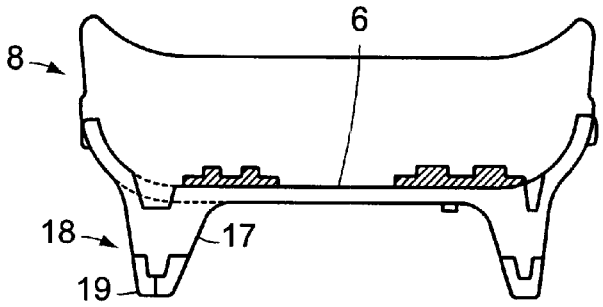
FIG. 6 is a schematic sectional view of a heel of an article of footwear in accordance with the invention.

The heel plate 6 depicted in FIG. 1 has a generally circular shape, however, the plate is not limited to a generally circular shape. The heel plate 6 may be generally U-shaped or V-shaped, for example. In one embodiment, the heel plate 6 includes molded cleats 18 protruding therefrom. The cleats 18 and heel plate 6 may be molded as one piece. Alternatively, a lug portion 17 of molded cleat 18 may be formed as part of heel plate 6 with a lug tip, or ground-engaging portion, 19 of cleat 18 attached to the lug portion 17 as illustrated in FIGS. 5 and 6.

FIG. 1 depicts the heel plate 6 with four molded cleats 18 arranged in a generally circular configuration; however, the heel plate 6 may have more or less than four cleats 18 and the cleats 18 may be arranged in a variety of configurations. The heel plate 6 may be manufactured from a hard plastic material such as thermoplastic polyether block amides like the Pebax® brand sold by Elf Atochem, TPU, thermoplastic polyester amides, compressed rubber, or an equivalent material. A window 7 could be added to reduce the weight or otherwise modify the properties of the heel plate 6. Possible materials for such a window 7 are TPU or other suitable material. The ground-engaging portion of the cleat may be manufactured from a polymer material, such as TPU, Pebax®, polyamide, or compressed rubber, or an equivalent material. In one embodiment, thermoplastic polyurethane-ester (TPU-ester) is used for the molded cleats due to its abrasion-resistant properties and use in injection plates. In another embodiment, the heel plate 6 has a Pebax® base and lug portion 17 and a TPU lug tip, or ground-engaging portion, 19. In yet another embodiment, the heel plate 6 and lug portions 17 comprise a TPU-ester having a Shore hardness of about 65 durometer and the lug tips 19 will comprise a high abrasion TPU with a Shore hardness of 95A. Other suitable materials will be apparent to those skilled in the art.

Figure 2:
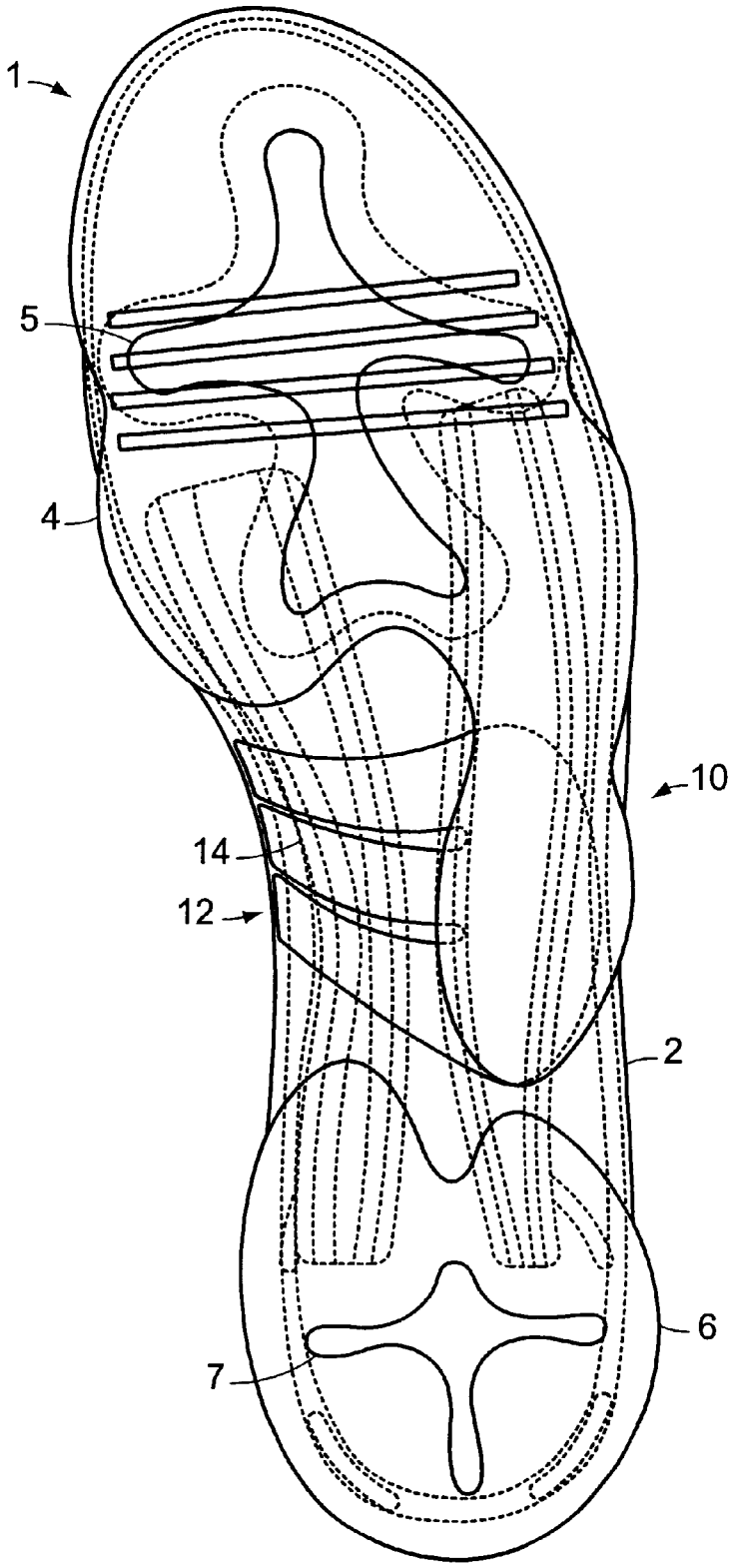
FIG. 2 is a schematic bottom view of one embodiment of a sole of an article of footwear for a left foot in accordance with the invention, with the cleats removed for clarity.

FIG. 2 is a bottom view of an article of footwear 1 having a sole 2 in accordance with the present invention. The article of footwear shown is for a left foot and illustrates the forefoot plate 4, heel plate 6, and stability element 14. The cleats 16, 18 are not shown for clarity.

Figure 3:
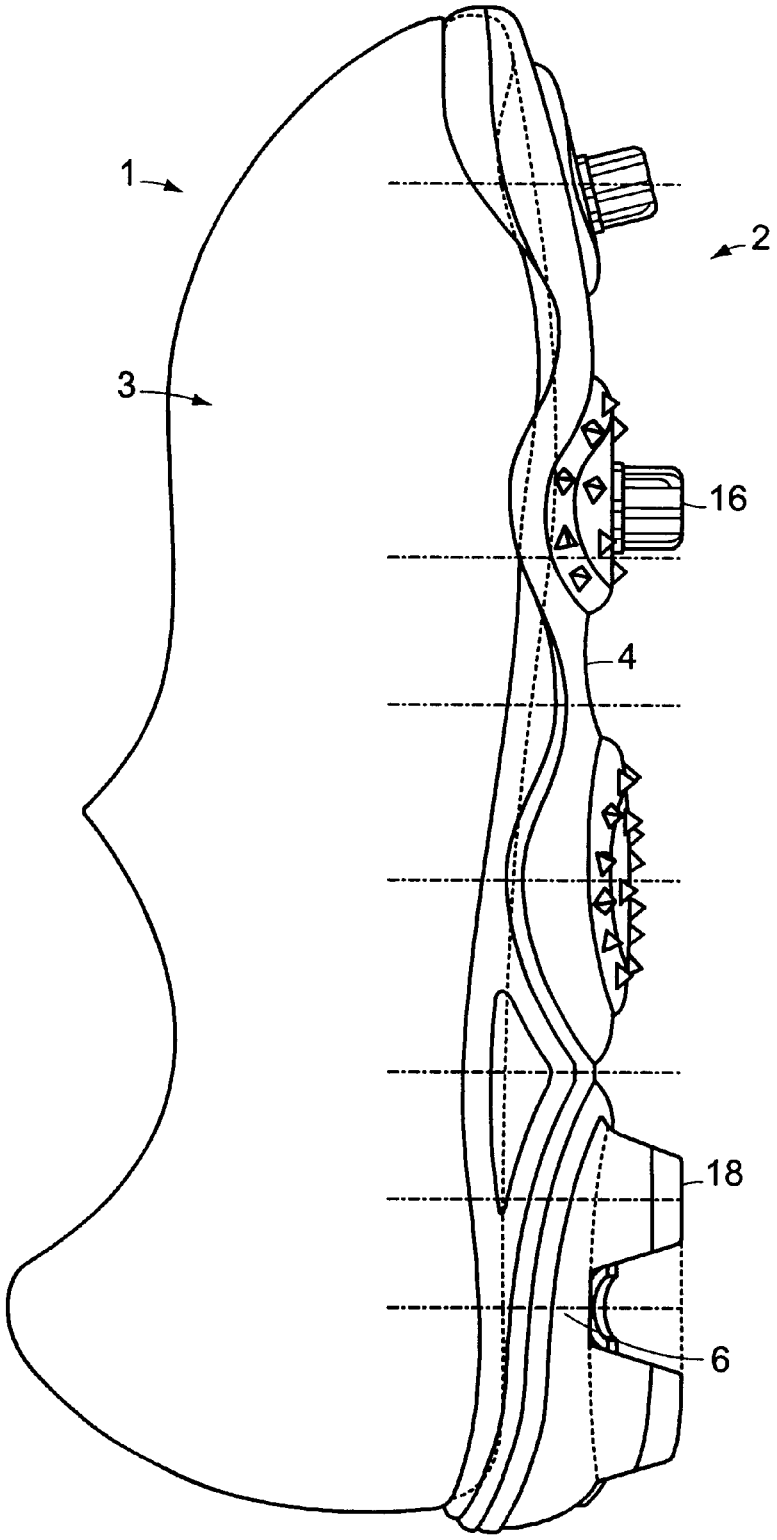
FIG. 3 is a schematic lateral side view of the sole of FIG. 1.

FIG. 3 is a lateral side view of the article of footwear 1 of FIG. 1. The figure illustrates the forefoot plate 4, the heel plate 6, and the cleats 16, 18. The forefoot plate 4 is contoured and the heel plate 6 and cleats 18 are formed as one piece. Shoe upper 3 is shown for reference only and may be any type of upper used for cleated footwear.

Figure 4:
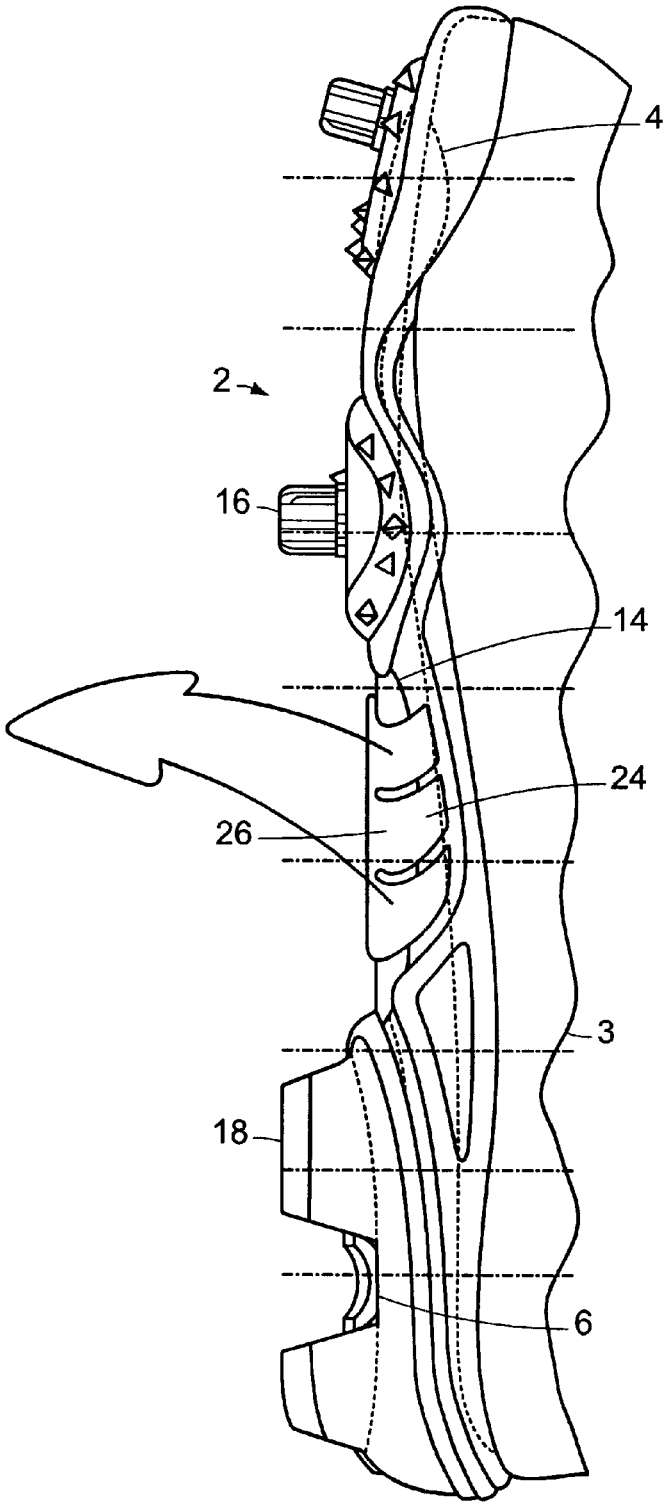
FIG. 4 is a schematic partial medial side view of the sole of FIG. 1.

FIG. 4 is a medial side view of the sole 2 of FIG. 1. The figure illustrates the forefoot plate 4, the heel plate 6, the stability element 14, and the cleats 16, 18. The forefoot plate 4 is contoured and the heel plate 6 and cleats 18 are formed as one piece. The stability element 14 shown includes a transverse element 24 having three fingers 26 and is described in more detail with respect to FIGS. 8 and 9.

FIG. 5 is a rear view of the heel 8 of the article of footwear 1 of the present invention. The figure depicts the molded cleat 18 with lug portion 17 and lug tip 19.

FIG. 6 is a cross-sectional view of the heel 8 taken at line 6—6 and provides a detailed illustration of one embodiment of the cleat 18 and heel plate 6 in accordance with the invention. The cleat 18 can be incorporated into the heel plate 6 when the latter is produced. The lug portion 17 of the cleat 18 can be molded as part of the heel plate 6. In this embodiment, the lug tip 19 is attached to the lug portion 17, for example by bonding thereto.

Figure 8:
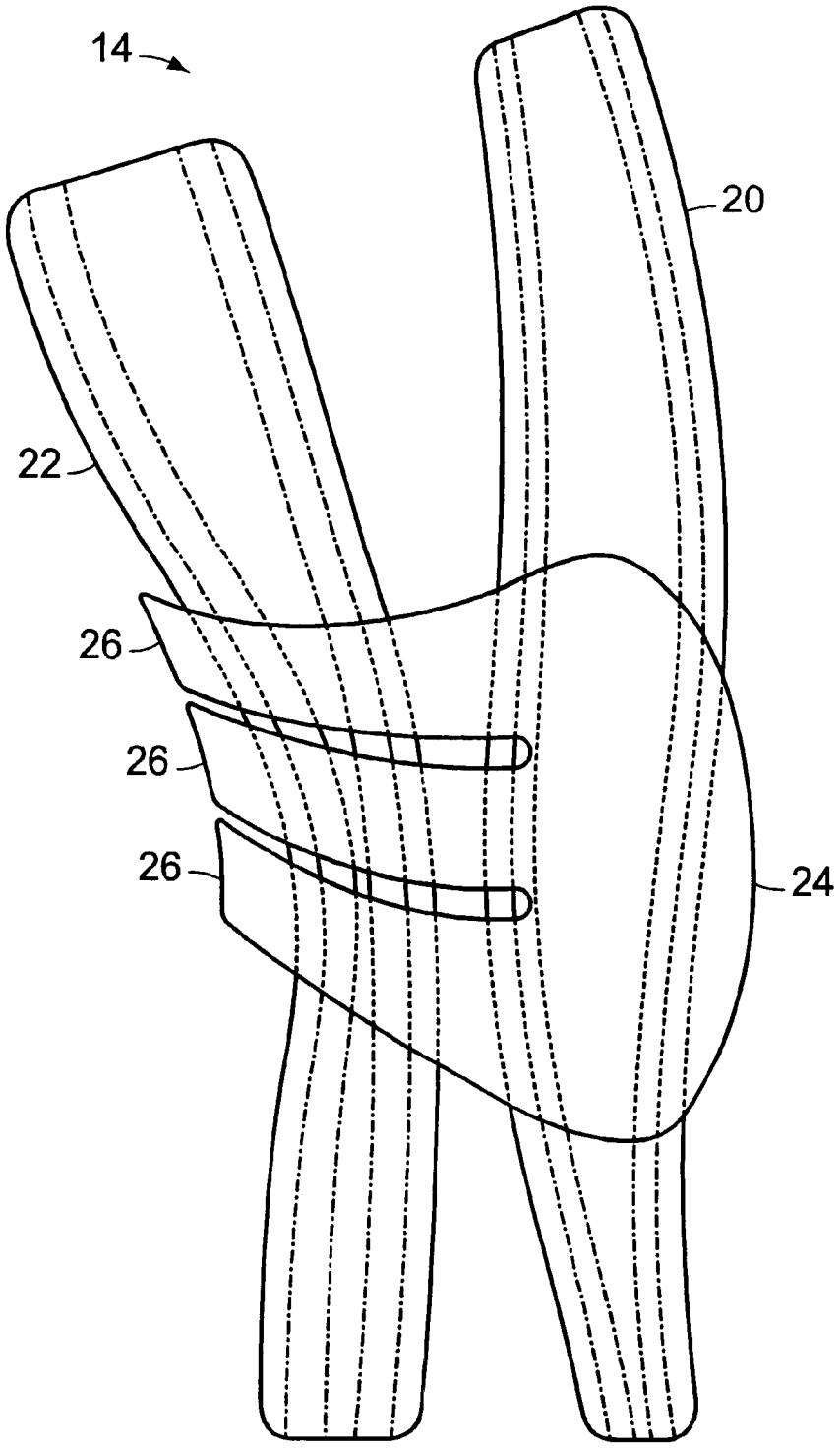
FIG. 8 is a schematic bottom view of one embodiment of a stability element for an article of footwear for a left foot in accordance with the invention.

FIG. 8 is a schematic bottom view of one embodiment of a stability element 14 for a left shoe in accordance with the invention. The stability element 14 includes a lateral longitudinal element 20, a medial longitudinal element 22, and a transverse element 24. The stability element 14 connects the forefoot plate 4 and the heel plate 6. The transverse element 24 connects the lateral longitudinal element 20 and the medial longitudinal element 22. The lateral and medial longitudinal elements 20, 22 are generally planar and run substantially the length of the shoe. The transverse element 24 includes a plurality of fingers 26. The transverse element 24 shown has three fingers 26 forming a generally E-shaped element. Suitable materials for the stability element include a composite material of carbon fibers embedded into a primary matrix of resin, thermoplastics, such as Pebax®, which may or may not be reinforced with other fibers, or composite materials, which may include graphite, fiberglass, or para-aramid fibers, such as the Kevlar® brand sold by DuPont or equivalent materials. In one embodiment, the stability element comprises Nylon 12, wherein the Nylon 12 may include 10 to 30 percent glass fiber reinforcement. Other suitable materials will be apparent to those skilled in the art.

Figure 9:
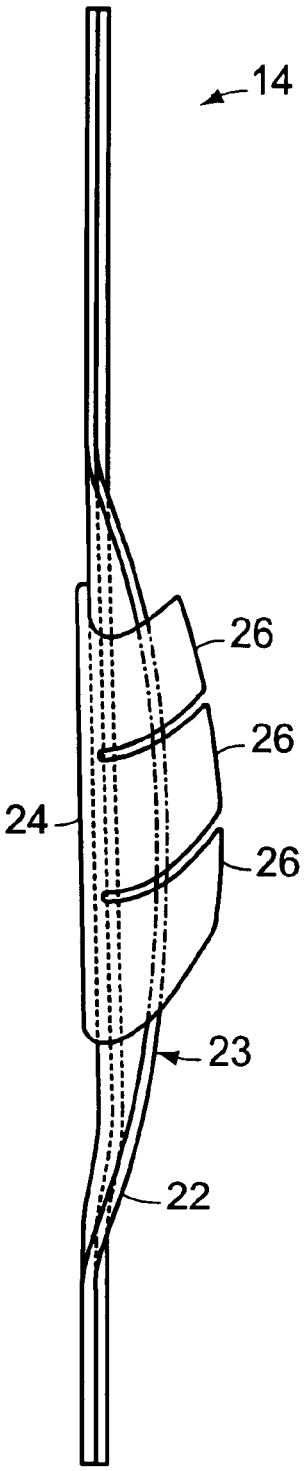
FIG. 9 is a schematic medial side view of the stability element of FIG. 8.

FIG. 9 is a schematic side view of the stability element 14 of FIG. 8. The medial longitudinal element 22 is shown offset in the arch region 23 to support a wearer's arch.

Figure 10A:
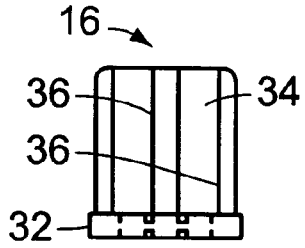
FIG. 10A is a schematic side view of one embodiment of a forefoot cleat for an article of footwear in accordance with the invention.
Figure 10B:
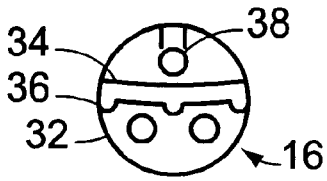
FIG. 10B is a schematic bottom view of one embodiment of a forefoot cleat for an article of footwear in accordance with the invention.

FIG. 10A is a schematic side view of one embodiment of an alloy cleat 16 in accordance with the present invention. The cleat 16 includes a mounting base 32, a body 34 and three stiffening ribs 36. The stiffening ribs 36 are integrally formed with the body 34 of the cleat 16. The mounting base 32 is generally planar and may have a round, rectangular, or other shape.

FIG. 10B is an end view of the alloy cleat 16. The cleat 16 includes a round mounting base 32, a body 34 and three stiffening ribs 36. The stiffening ribs 36 are integrally formed with the body 34 of the cleat and are equally spaced along the body 34. The body 34 has an arcuate cross-section; however, the cross-section may also be linear or rectangular. The mounting base 32 includes three holes 38; however, the mounting base 32 is not limited to three holes. Any number or shape of aperture may be used to properly facilitate mounting the cleat 16 to the forefoot plate 4.

Having described preferred and exemplary embodiments of the invention, it will be apparent to those of ordinary skill in the art that other embodiments incorporating the concepts disclosed herein can be used without departing from the spirit and the scope of the invention. The described embodiments are to be considered in all respects only as illustrative and not restrictive. Therefore, it is intended that the scope of the present invention be only limited by the following claims.

What is claimed is:

1. An article of footwear including a sole including a forefoot region, a midfoot region, and a heel region, the sole comprising:

a forefoot plate of unitary construction covering substantially the entire forefoot region and solely one of a medial side and a lateral side of the midfoot region of the footwear;

a heel plate covering solely the heel region of the footwear;

at least one alloy cleat protruding from the forefoot plate; and at least one molded cleat protruding from the heel plate.

2. The article of footwear of claim 1, wherein the at least one alloy cleat is made from a non-ferrous metal alloy.

3. The article of footwear of claim 2, wherein the at least one non-ferrous metal alloy cleat is made from an aluminum-based alloy.

4. The article of footwear of claim 1, wherein the at least one alloy cleat is made from a ceramic alloy.

5. The article of footwear of claim 1, wherein the at least one alloy cleat is made from a titanium-based alloy.

6. The article of footwear of claim 1, wherein the at least one alloy cleat is made from a magnesium-based alloy.

7. The article of footwear of claim 1, wherein there are four alloy cleats protruding from the forefoot plate.

8. The article of footwear of claim 7, wherein the four alloy cleats are arranged in a generally circular configuration.

9. The article of footwear of claim 8, wherein the generally circular configuration is centered generally about a third metatarsal area of the footwear.

10. The article of footwear of claim 1, wherein the at least one alloy cleat has a generally arcuate cross-section.

11. The article of footwear of claim 1, wherein there are four molded cleats protruding from the heel plate.

12. The article of footwear of claim 11, wherein the four molded cleats are arranged in a generally circular configuration.

13. The article of footwear of claim 1, wherein the heel plate comprises a generally circular shape.

14. The article of footwear of claim 1, wherein the forefoot plate extends into the midfoot region solely along the lateral side.

15. The article of footwear of claim 1, wherein the sole further comprises a stability element coupling the forefoot plate and the heel plate.

16. An article of footwear including a sole, the sole comprising:

a forefoot plate;

a heel plate;

a stability element coupling the forefoot plate and the heel plate, wherein the stability element comprises a generally longitudinally disposed lateral element, a generally longitudinally disposed medial element, and a transverse element connecting the lateral element and the medial element;

at least one alloy cleat protruding from the forefoot plate; and at least one molded cleat protruding from the heel plate.

17. The article of footwear of claim 16, wherein the transverse element includes a plurality of fingers.

18. The article of footwear of claim 16, wherein the transverse element includes three fingers forming a generally E-shaped element.

19. The article of footwear of claim 1, wherein the forefoot plate does not extend into the medial side of the midfoot region of the footwear.

20. An article of footwear including a sole including a forefoot region, a midfoot region, and a heel region, the sole comprising:

a forefoot plate of unitary construction covering substantially the entire forefoot region and substantially an entire length of at least one of a medial side and a lateral side of the midfoot region of the footwear;

a heel plate covering solely the heel region of the footwear;

at least one alloy cleat protruding from the forefoot plate; and at least one molded cleat protruding from the heel plate.

* * * * *